US007836559B2

(12) United States Patent
Menoudakos

(10) Patent No.: US 7,836,559 B2
(45) Date of Patent: Nov. 23, 2010

(54) TEETHING HOLDER

(76) Inventor: Athenas Menoudakos, 23 Raymond Ct., Garden City, NY (US) 11530

( * ) Notice: Subject to any disclaimer, the term of this patent is extended or adjusted under 35 U.S.C. 154(b) by 893 days.

(21) Appl. No.: 11/784,959

(22) Filed: Apr. 10, 2007

(65) Prior Publication Data

US 2008/0255614 A1 Oct. 16, 2008

(51) Int. Cl.
*A45F 5/00* (2006.01)
*A45F 5/02* (2006.01)
*A61J 17/00* (2006.01)

(52) U.S. Cl. ..... 24/3.13; 24/3.1; 606/325

(58) Field of Classification Search ..... 24/3.1, 24/3.12, 3.13, 3.4, 9, 265 EC, 30.5 R; 606/234–236
See application file for complete search history.

(56) References Cited

U.S. PATENT DOCUMENTS 1,828,106 A 10/1931 Ertola
2,604,404 A 7/1952 Genjack
3,187,396 A * 6/1965 Carroll ..... 24/115 R
3,431,007 A 3/1969 Paulsen et al.
4,532,833 A 8/1985 Downs
5,150,504 A 9/1992 Cohen
5,666,693 A 9/1997 Levay
5,671,508 A * 9/1997 Murai ..... 24/115 K
5,896,623 A * 4/1999 Martin ..... 24/16 PB
6,241,415 B1 6/2001 Stark
7,204,468 B2 * 4/2007 Kintzele et al. ..... 248/690

* cited by examiner

*Primary Examiner*—Robert J Sandy
(74) *Attorney, Agent, or Firm*—Douglas C. Wyatt

(57) ABSTRACT

A teething holder for use with a child's teething item, and more particularly a teething device having a flexible and elastic loop, a lock for releaseably locking the loop around a teething object, such as a biscuit, and an attachment element, for attaching the teething device, such as to a baby's bib or chair.

11 Claims, 3 Drawing Sheets

TEETHING HOLDER

FIELD OF THE INVENTION

This invention is related to the art of teething holders, and more particularly related to the art of teething holder systems for holding food, teething biscuits, or other teething instruments for young children.

BACKGROUND OF THE INVENTION

Young children who are in the teething stage of development, often need the use of teething biscuits, and semi-hard objects to help the development of healthy teeth and gums. In addition, young children often require use of objects to satisfy a natural desire to suckle or otherwise provide oral fixation. However, it has heretofore been difficult for an attending parent or other responsible individual to monitor young children's use of teething devices since young children often drop the teething devices, and the teething devices can be become lost or dirty. In addition, the teething device can sometimes become lodged in children's mouths or throats and present the danger of choking.

Accordingly, there is a need for a teething device which allows for the use of various teething objects or food while preventing the teething object or food from becoming lost or dirty when dropped by a young child, and prevent teething objects from becoming swallowed by the child.

In the past, various devices have been used for holding objects, some of which have been adapted for use with children. However, none of the devices provide an efficient, and simple teething holder which can hold a variety of teething devices, and which can be tethered to a chair or piece of child's clothing.

U.S. Pat. No. 6,241,415 for an "adjustable and reusable handle for containers" describes a device for holding a container using an elongated handle. An adjustable band is mounted at one end, and has two sections which project from opposite ends. The two sections overlap to form a loop and each section is provided with a series of openings to allow a clip to receive the overlapping sections and lock the loop by use of the openings. This device is inapplicable to the art of child teething devices, and inappropriate for adaptation to teething holders at least for the reasons that the overlapping band and clip would be uncomfortable for a child's mouth.

U.S. Pat. No. 5,666,693 for a "toy handle for oral device" provides a novelty device simulating a portion of a character or an object, such as a half of an animal. The device is provided to function as a toy handle for use with oral devices such as lollipops or teething rings, which are periodically placed in the mouth of the user and provided with a handle allowing periodic removal. The toy handle has a securing structure disposed within a receiving channel of the handle, specifically a screw hole, such that a typical handle of an oral device, such as a wrapped paper handle of a lollipop, may be inserted into, secured, and removed from the handle. This toy handle is limited in its ability to hold a variety of teething devices as it is designed to hold a wrapped paper handle that can be secured within a threaded channel.

U.S. Pat. No. 5,150,504 for a "universal tether apparatus" provides a device for releasably attaching juvenile articles such as pacifiers, teething devices, rattles and toys, to the clothing of an infant. The device includes releasably affixable attachment members capable of alternatively coupling to and releasing from, both male post-type and female loop-type elements of juvenile articles. A flexible strap attached to a post attachment end and a second attachment member facilitates universal securement of either end of the strap to an apparatus body, or to a juvenile article. A biased clip facilitates releasable securement of the apparatus body to the infant's clothing. The tether device is limited to use with teething rings and devices that already have an attachment point. In addition, the attachment end of the tether requires Velcro or snaps, which can be undone by a child.

U.S. Pat. No. 4,532,833 for a "strip-type wrench for removing rotatable closures or similar members" describes a wrench comprising a handle carrying a flexible strap that is arranged as a loop with both of its ends anchored to the handle. A loop-adjusting slide is mounted on the handle for movement relative to the anchoring point and has the doubled ends of the strap slideably passing through it outwardly from the anchoring point so that movement of the slide adjusts to the size of the loop. A ratchet is provided to hold the slide member in a loop tightening position and a spring returns it to its original position upon release of the ratchet. This device is inapplicable to the art of child teething devices, and inappropriate for adaptation to teething holders at least for the reasons that the loop adjusting slide is a complicated mechanism, and does not accommodate simple, replaceable, flexible and elastic loops which can require replacement.

U.S. Pat. No. 3,431,007 for a "handle assembly" describes an assembly having a handle and a band for supporting a container and an extension of the band which is slideably adjustable in the handle. The handle is provided with a forwardly extending formation for engaging a container in order to stabilize the connection between the band and container. This device is inapplicable to the art of child teething devices, and inappropriate for adaptation to teething holders at least for the reasons that the device does not accommodate simple, replaceable, flexible and elastic loops which can require replacement, and does not allow for progressive slideable adjustments of the loop to tighten around the object being held, and instead provides fixed anchor points.

U.S. Pat. No. 1,828,106 for a "tool" for lifting or turning objects such as cans, jars, covers, and the like. The tool has a flexible band mounted with its ends secured to a nut slidably movable within a tubular handle. The band extends outwardly from the handle to form a loop adjustable by means of the nut to fit various objects to be engaged. This device is inapplicable to the art of child teething devices, and inappropriate for adaptation to teething holders at least for the reasons the device does not accommodate simple, replaceable, flexible and elastic loops which can require replacement.

U.S. Pat. No. 2,604,404 for a "baby safety and teething biscuit" which are formed so that babies are unable to break off pieces of dangerously large size. The biscuit includes a disc of compressed rice paper having a number of holes. The ring is covered on both sides with biscuit or cookie dough and the layers are subjected to sufficient pressure to cause the material to project through the holes forming plugs to hold the dough in position. The teething biscuit does not provide for a means of holding a variety of teething items, but is directed to a particular teething item.

OBJECT OF THE INVENTION

It is an object of the invention to provide a teething holder which can hold common teething food securely, which is durable, readily cleanable, and easy to use. It is a further object of the invention to provide a teething holder which meets child safety products standards. Another object of the invention, is to provide a teething holder with a tether which can attach to a child's wrist, a chair, clothing, and other such appropriate things, so that the teething object can be readily returned to the child's mouth once dropped. It is a further object of the invention to provide a teething holder with a reduced risk of choking. It is a further object of the invention to provide a teething holder that is easy to clean, and has replaceable parts available if the device needs to be fixed. It is a further object of the invention to provide a teething holder which can hold a teething item and prevent the teething item from falling out and entering the child's throat. It is a further object of the invention to provide a device which can help prevent teething items from being inadvertently swallowed by a child. It is a further object to provide a teething holder which can adjustably hold teething objects of various sizes and which can provide further tightening after use.

SUMMARY OF THE INVENTION

A teething holder is provided for holding a child's teething item. The device according to the invention includes a teething loop, at least a portion of which includes a substantially flexible and elastic material for wrapping around and holding the teething item. The material of the teething loop can be a length of material that is bent to provide a loop at one end, and has two terminal portions of the material at a teething loop end. The teething holder has a teething lock, which has a teething protrusion, and a locking mechanism. The teething lock is provided is disposed around at least a portion of teething loop so as to releasably lock a loop of the teething loop in a position around the teething item. The teething protrusion can provide the teething lock with additional size to prevent choking of an infant. Specifically, the teething lock can have at least a dimensional aspect of 2.25 inches by 1.25 inches to prevent the teething lock from being accidentally swallowed by a child. In addition, the teething holder is provided with an attachment element which can be connected to either the teething loop end or the teething lock for attaching the teething holder to an object, such as a piece of child's clothing or a chair.

BRIEF DESCRIPTION OF THE DRAWINGS

Preferred embodiments of the inventive devices are illustrated in the drawings and are described below.

Figure 1:
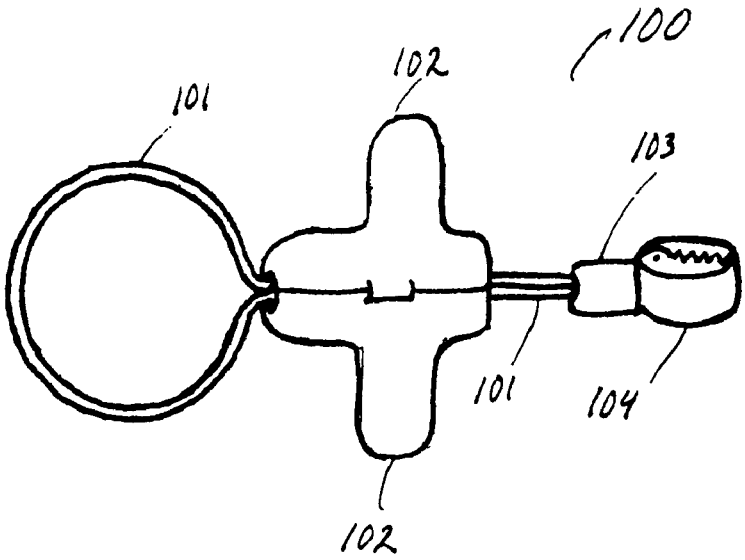
FIG. 1 illustrates a side view of a teething holder according to the invention.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION

A detailed description of teething holder devices is provided below for general applicability. In addition, several specific embodiments are provided as examples of the devices which one of ordinary skill in the art may apply these teachings to address specific problems and to illustrate the benefits and improvements of the system over known solutions.

A side view of a teething holder (100) according to the invention is shown in FIG. 1. A teething holder (100) includes a teething loop (101), a teething lock (102), and an attachment element (104).

The teething loop (101) comprises a loop portion at one end and a terminal portion at the other end. The teething loop (101) can be constructed of a length of material that is flexible and durable such that a portion of the teething loop (101) can be wrapped around a teething item with one or more loops and another portion can be held securely by the teething lock (102). Alternatively, or in addition, the teething loop (101) may include an elastic and durable material at a loop portion for holding the teething item, and comprise additional materials for operatively locking with the teething lock (102) and for connection to the attachment element (104). For example, the teething loop (101) can comprise both elastic and fabric material. The teething loop (101) is preferably constructed of a material that is safe for a child's mouth, and which is FDA approved for food contact grades and is dishwasher safe.

It is preferable that the teething loop (101) be comprised of a length of material that is flexible, durable and elastic. Flexible and elastic material is preferable for its ability to be cinched around food and other teething items, and retain the ability to hold a teething item after a period of teething. Whereas a rigid material may permit the food or other teething item to become loose upon teething and thus allow the teething item to fall out of the loop. For example, a biscuit or pretzel can be held by the teething loop (101) and used as a teething item. Durable material is preferable since teething activity can cause non-durable materials to eventually break down. The teething loop (101) can be made of silicon rubber tubing, elastic material, or heavy string, among other things. The teething loop (101) can also include a length of material that is non-elastic, such as at the end of the teething loop (103), and which can be provided either at a loop portion of the teething loop (101) or at a distal portion of the teething loop (101) such as where the attachment element (104) is provided.

One embodiment of a teething holder (100) according to the invention can also include a teething loop end (103) for attaching the teething loop (101) to the attachment element (104). The teething loop end (103) can be a terminal portion of the teething loop (101). Alternatively, or in addition, the teething loop end (103) can be a piece of webbing or other material to extend the reach of the attachment element (104). Alternatively, or in addition, the teething lock (102) can be provided with a connection, such as a molded-in loop, for direct connection to the attachment element (104).

Figure 2:
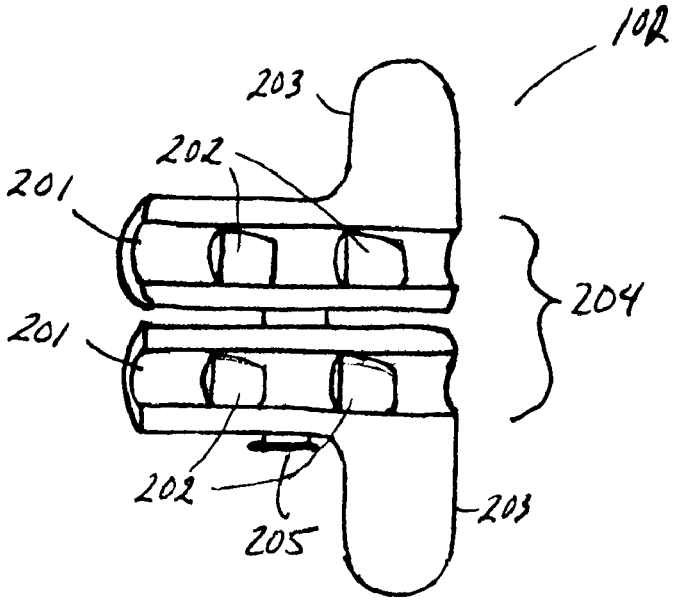
FIG. 2 illustrates a detailed view of an opened teething lock according to the invention.

A cross-section view of an embodiment of a teething lock (102) is shown in FIG. 2 in an open position.

A teething lock (102) is provided comprising a clamp (204), a locking mechanism (205) and a teething lock protrusion (203). The clamp (204) provides a suitable means for releasably holding a variety of materials that comprise the teething loop (101). The clamp (204) facilitates replacement of the teething loop (101) such as when a teething loop (101) becomes worn. An appropriate clamp (204) can be formed as part of the teething lock (102) as cavity (201) through which the teething loop (101) can pass. The clamp (204) can formed to include teeth, ribs or other materials (202) to hold the teething loop and can be formed to allow unidirectional travel of the teething loop (101) through the teething lock (102).

The teething lock (102) is further provided with a locking mechanism (205) for locking the clamp (204) in a closed position. The locking-mechanism (205) can be formed as part of the teething lock (102) for holding the teething loop (101).

Figure 3:
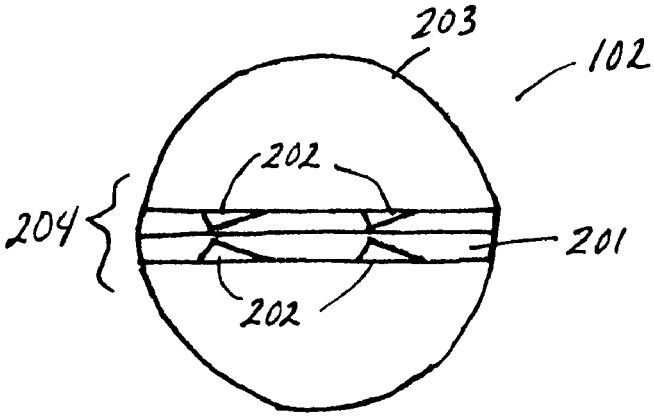
FIG. 3 illustrates a detailed view of another embodiment of a teething lock according to the invention.
Figure 4:
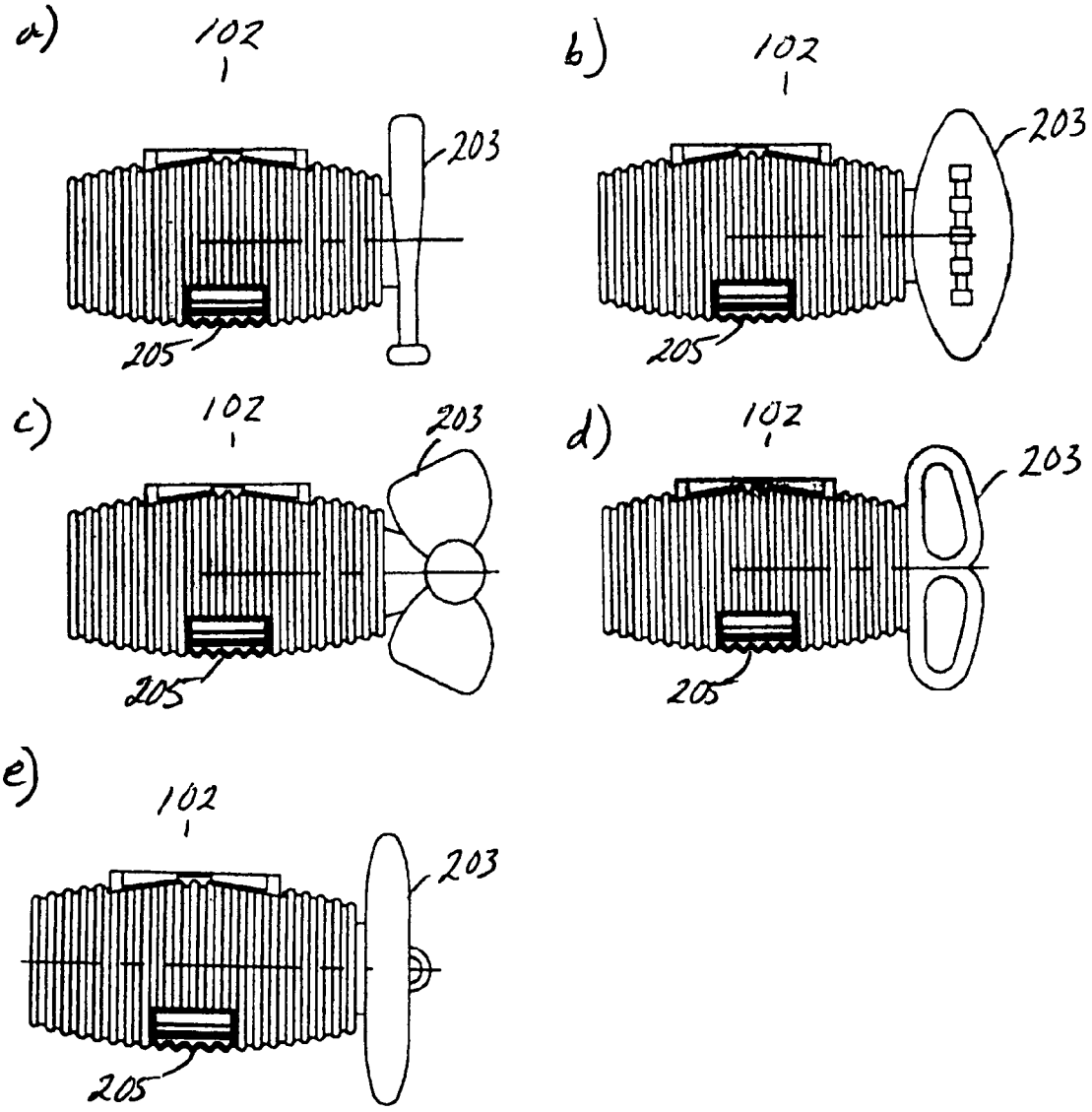
FIG. 4 illustrates a side view of several alternative embodiments of a teething lock according to the invention, wherein the teething lock protrusion is provided having variety of aesthetically pleasing shapes.

The teething lock (102) is further comprised of a teething lock protrusion (203). The teething lock protrusion (203) provides the teething lock (102) with sufficient size to prevent choking, and accordingly can be formed as an enlarged body of the teething lock (102), as shown in FIG. 3, or as one or more extensions of the teething lock, as shown in FIGS. 1, 2, and 4. Specifically, the teething lock can have at least a dimensional aspect of 2.25" by 1.25" to prevent the teething lock from being accidentally swallowed by a child.

The teething lock (102) can be formed of two pieces to allow ease of cleaning and to reduce manufacturing costs. In one embodiment, two pieces of the teething lock (102) can be hinged together and locked into a closed position, or unlocked to an open position. For example, opening of the teething lock (102) is preferably provided as a child proof interlocking mechanism. The teething lock (102) can be comprised of a rigid material that is child safe, such as polyethylene or polypropylene, and can be manufactured by injection molding. It is preferable that the material be approved by the FDA for food contact grades and be dishwasher safe.

The teething lock (102) permits a loop portion of the teething loop (1101) to be cinched down to an appropriate size for holding the teething item. For example, as shown in FIG. 3, a side view of an embodiment of the teething lock (102) can be provided with a clamp (204), such as teeth formed in the teething lock which can lock the teething loop (101) in one direction, while allowing uni-directional movement of the teething loop (101) through the teething lock (102) in a direction away from the loop portion holding the teething item. Thus, the teething lock (102) allows the loop portion to be cinched down around the teething item for a tight hold. In addition, the teething loop (101) easily permits further adjustment and tightening after a child has used the teething device for a period of time.

FIG. 4 shows several alternative embodiments of a teething lock (102), wherein the teething lock (102) can be provided with tactile features (401) on its outer surface and wherein the teething protrusion (203) is provided as an aesthetically pleasing shape.

In an alternative embodiment, the clamp (204) of the teething lock (102) can be provided as a spring for holding the teething loop (101). In such an embodiment, the teething loop (101) can be formed of an elastic material, such as a silicon strip, which can slide through the spring in an open position. When the spring is pushed toward the loop end of the teething loop (101), the spring, acting as the clamp (204), can assume a locked position and the teething loop (101) can thereby be locked in a smaller, constricted position around the teething item. When the spring is pushed away from the loop end of the teething loop (101), the spring opens, and thereby allows the teething loop (101) to be released and enlarged.

The attachment element (104) is attached to the teething loop (101) at the teething loop end (103). The attachment element (104) can be a number of different attachment means, as can be appreciated by a person of ordinary skill in the art. For example, the attachment element (104) can be a thin strap or loop that can be put around a child's wrist, or a spring clip for attachment to the child's clothing, bib, chair, or other things. In addition, the attachment element (104) can be a hook-to-mesh fabric attachment means or an alligator clip. The attachment element can combine one or more attachment means. Thus, the attachment element (104) allows the teething holder (100) to be attached to a child's wrist, a stroller, a chair, or a child's article of clothing among other things and thereby prevent the teething item from becoming lost or dirty should it become dropped by the child.

Figure 5:
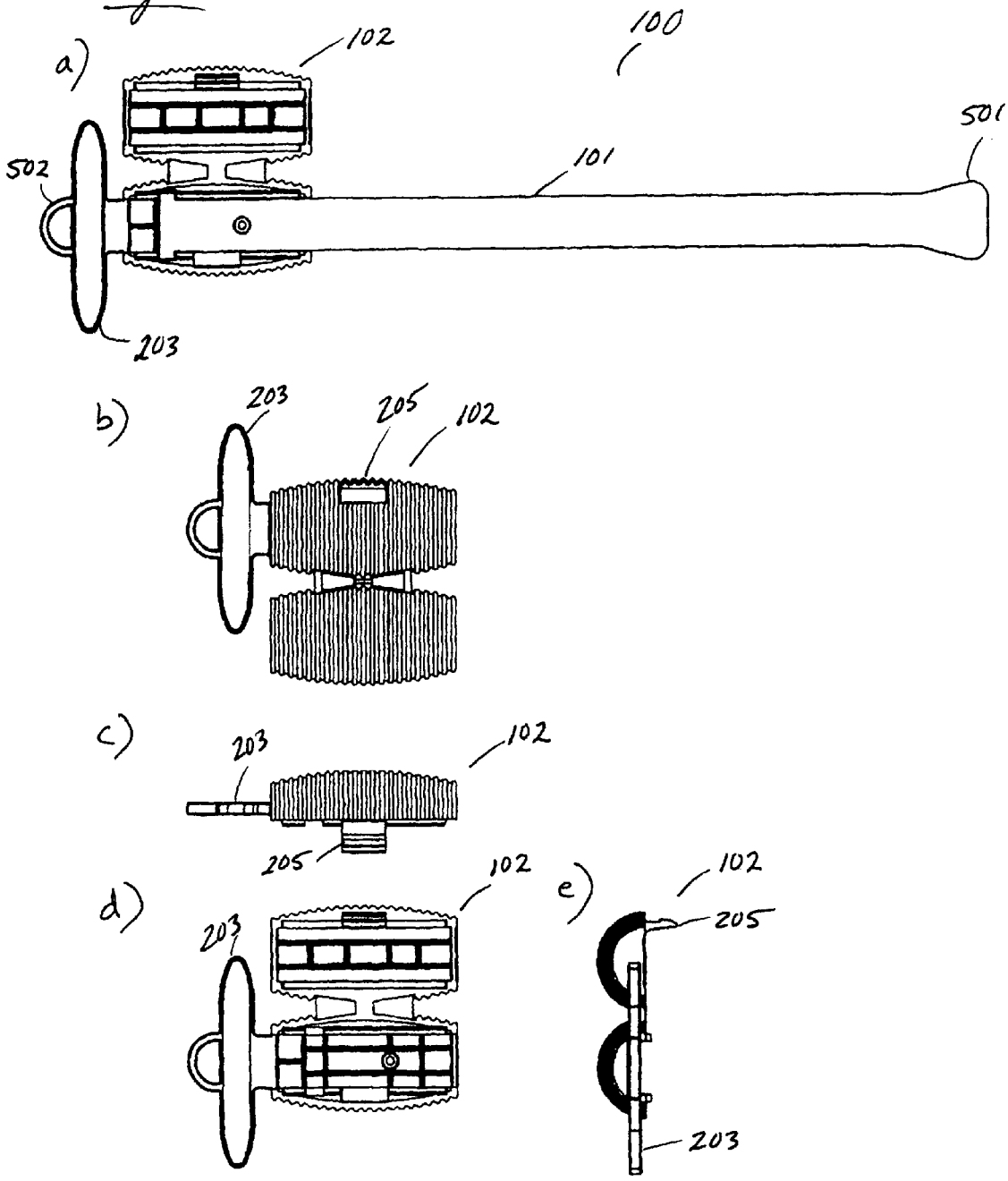
FIG. 5 is an alternative embodiment of a teething holder according to the invention, including several views of an alternative embodiment of the teething lock.

FIG. 5 shows an alternative embodiment of the teething holder (100) and several side views showing detail of an alternative teething lock (102). A teething loop (101) is provided, having one end terminating at a fixed position in the teething lock (102). One end of the teething loop (101) can be removably fixed by a pin in the cavity of the teething lock (102), among other things. Another end of the teething loop (101) can be provided with a loop end stop (105) to prevent the teething loop (101) from being pulled through the teething lock (102) when the teething loop (101) is employed as a loop and the teething lock (102) is in a locked position. The attachment element (104), not shown, can be attached directly to the teething lock (102), such as at an anchor (502) disposed on the teething lock (102).

It can be appreciated that appropriate teething items for use with the teething holder include items that are safe for children's teething. Such items include biscuits, and other digestible products, and can be notched for receiving the loop of the teething loop (102). Alternatively, it can be appreciated that non-digestible teething items can be used, which items are preferably child-safe to avoid choking, among other things.

The invention claimed is:

1. A teething holder for use with a child's teething item, comprising:

a teething loop, said teething loop comprising at least a length of material that is substantially flexible and durable, and having a loop portion and at least one distal end portion;

a teething lock, said teething lock having a clamp, a teething lock protrusion, and a locking mechanism, said clamp being releasably disposed around at least a portion of the teething loop; and an attachment element, said attachment element being connected to at least one of the teething loop end and the teething lock, wherein the teething loop comprises an elastic portion and an inelastic portion, wherein the elastic portion is provided at the loop portion and the inelastic portion is provided at the at least one distal end portion.

2. A teething holder according to claim 1, wherein the clamp comprises a cavity and a plurality of teeth, wherein the teeth are disposed at an angle to allow unidirectional movement of the teething loop in a locked position.

3. A teething holder for use with a child's teething item, comprising:

a teething loop, said teething loop comprising at least a length of material that is substantially flexible, elastic and durable, and having a loop portion and at least one distal end portion;

a teething lock, said teething lock having a clamp, and a locking mechanism, wherein the clamp comprises a cavity and a plurality of teeth, and is releasably disposed around at least a portion of the teething loop, wherein the teeth are disposed at an angle to allow unidirectional movement of the teething loop in a locked position; and an attachment element, said attachment element being connected to the teething loop end, wherein the attachment element comprises at least one of a clip, a loop, and hook-to-mesh attachment means.

4. A teething holder according to claim 3, further comprising a teething lock protrusion.

5. A teething holder according to claim 4, wherein the teething lock protrusion provides the teething lock with a dimension of at least 2.25" by 1.25".

6. A teething holder according to claim 4, wherein the teething lock protrusion is provided as having an aesthetically pleasing shape.

7. A teething holder for use with a child's teething item, comprising:

a teething loop, said teething loop comprising at least a length of material that is substantially flexible, and durable, and having a loop portion and at least one distal end portion;

a teething lock, said teething lock having a clamp and a locking mechanism, wherein the clamp comprises a cavity and a plurality of teeth, and is releasably disposed around at least a portion of the teething loop, wherein the teeth are disposed at an angle to allow unidirectional movement of the teething loop in a locked position; and an attachment element, said attachment element being connected to the teething loop end at the at least one distal end portion, wherein the attachment element comprises at least one of a clip, a loop, and hook-to-mesh attachment means.

8. A teething holder according to claim 7, wherein the teething loop comprises an elastic portion and an inelastic portion, wherein the elastic portion is provided at the loop portion and the inelastic portion is provided at the at least one distal end portion.

9. A teething holder according to claim 7, further comprising a teething lock protrusion.

10. A teething holder according to claim 9, wherein the teething lock protrusion provides the teething lock with a dimension of at least 2.25" by 1.25".

11. A teething holder according to claim 9, wherein the teething lock protrusion is provided as having an aesthetically pleasing shape.

* * * * *